US005251521A

United States Patent [19]

Burda et al.

[11] Patent Number: 5,251,521

[45] Date of Patent: Oct. 12, 1993

[54] TORX-COMPATIBLE ELLIPTICAL DRIVER

[75] Inventors: Dennis A. Burda, Buffalo; Michael D. Blackston, Hopkins, both of Minn.

[73] Assignee: Bondhus Corporation, Monticello, Minn.

[21] Appl. No.: 830,367

[22] Filed: Jan. 31, 1992

[51] Int. Cl.[5] ..... B25B 23/00

[52] U.S. Cl. ..... 81/460; 81/436

[58] Field of Search ..... 81/436, 461

[56] References Cited

U.S. PATENT DOCUMENTS

| | | |
|---|---|---|
| 1,274,254 | 1/1918 | Fleek . |
| 2,951,396 | 9/1960 | Kooistra . |
| 2,984,995 | 5/1961 | Kalen . |
| 3,427,825 | 2/1969 | John et al. . |
| 3,635,048 | 1/1972 | Monti . |
| 3,940,946 | 3/1976 | Andersen . |
| 4,246,811 | 1/1981 | Bondhus et al. . |
| 4,824,418 | 4/1989 | Taubert . |

FOREIGN PATENT DOCUMENTS

| | | |
|---|---|---|
| 20665 | 4/1882 | Fed. Rep. of Germany . |
| 1172488 | 6/1964 | Fed. Rep. of Germany . |
| 1296894 | 6/1969 | Fed. Rep. of Germany . |
| 1728574 | 8/1974 | Fed. Rep. of Germany . |
| 1410767 | 8/1965 | France . |
| 940354 | 10/1963 | United Kingdom . |
| 2138104 | 10/1984 | United Kingdom . |
| WO87/01164 | 2/1987 | World Int. Prop. O. . |

*Primary Examiner*—James G. Smith

*Attorney, Agent, or Firm*—Merchant, Gould, Smith, Edell, Welter & Schmidt

[57] ABSTRACT

A drive element for use with TORX® compatible fasteners with an elliptical cross-section attached to an elongated shaft along the central longitudinal axis of the shaft. The minor axis of the ellipse extends along the central longitudinal axis of the elongated shaft. The elliptical cross-sections of the drive element are located on planes which pass through the minor axis. A major axis plane perpendicular to the minor axis is located at the center of the drive element. The drive element has elevations forming drive lobes and depressions which traverse a longitudinal elliptical path on the surface of the drive element. The lobes and depressions are substantially complimentary to the inner surface of a fastener cavity at the major axis plane. Starting at the major axis plane, the lobes become narrower as they approach the minor axis. The centers of curvature for the tops of the lobes are a series of points which define a first reference circle on the major axis plane with the minor axis as the center. The centers of curvature for the bottoms of the depressions are a series of points which define a second reference circle concentric with the first circle, also on the major axis plane. The drive element of the present invention can effectively transmit increased levels of torque to the fastener even when pivoted with respect to the fastener cavity.

4 Claims, 8 Drawing Sheets

TORX-COMPATIBLE ELLIPTICAL DRIVER

FIELD OF THE INVENTION

The present invention relates to a tool for use with TORX® compatible fasteners, in particular, to an elliptical driver with an elliptical cross-section which provides increased torque transmission between the driver and the fastener, even when in a non-coaxial relationship.

BACKGROUND OF THE INVENTION

There are numerous applications for fasteners which can withstand high torque transmission from their associated tool. One such high torque transmission fastener/tool combination is known in connection with German Patent No. 1728574, commercially available under the trade name TORX® or equivalent. The head of a TORX® compatible fastener has a cavity shaped like a hollow cylinder. The inner surface of the cavity defines a continuous curve of uniformly distributed elevations and depressions. The elevations and depressions forming the inner surface of the cavity are parallel to an axis passing longitudinally through the center of the fastener and the cavity. Commercially available TORX® compatible fasteners typically have six depressions and six elevations, forming a generally hexagonal shaped cavity. The corresponding TORX® tool has an outer surface which defines a continuous curve where the elevations and depressions are parallel to the longitudinal axis of the tool. The uniformly distributed elevations and depressions of the tool are complementary to the inner surface of the fastener cavity.

The elevations and depressions increase the total surface area available for engagement between the fastener cavity and the driver, thereby increasing torque transmission capabilities. Traditional TORX® tools, however, can only be inserted vertically into the fastener cavity along the center longitudinal axis of the fastener. Tools of this construction can not be pivoted or tilted with respect to the longitudinal axis of the fastener. This limitation is particularly problematic when the fastener is located in a difficult to reach location.

The prior art which has attempted to overcome this limitation has a number of shortcomings. U.S. Pat. No. 4,824,418, issued to Taubert discloses an articulated power transmission joint with a substantially spherical driver with alternating depressions and elevations on its surface which are complimentary to the inner surface of the cavity on a TROX® compatible fastener. The structure disclosed by Taubert allows the axis of the driver to be pivoted with respect to the longitudinal axis of the fastener, while maintaining engagement of the respective elevations and depressions to rotate the fastener.

Due to its spherical structure, the drive element disclosed by Taubert has less surface area available for engagement with the elevations and depressions on the inner surface of the cavity than on traditional TORX® compatible tools, resulting in reduced torque transmission capabilities and potential damage to either part of the transmission device. When the drive element is pivoted in relation to the longitudinal axis of the fastener, the surface area available for engagement between the tool and the fastener cavity is further reduced.

In order to maximize torque transmitting capacity, the centerline dividing the driver into upper and lower halves should be below the centerline in the depth of the fastener cavity. The spherical nature of the Taubert driver is such that the centerline of the drive element tends to be substantially above the centerline in the depth of the fastener cavity. When the driver is pivoted at an angle with respect to the centerline of the fastener, the transmission of torque to the fastener causes the spherical driver to disengage or "walk out" of the fastener cavity.

In order to maximize the pivoting capabilities of the tool with respect to the center axis of the fastener cavity, the spherical driver has a narrower cross-section than would otherwise be necessary. The reduced diameter of the Taubert driver also results in a reduction in surface area of contact between the driver and the fastener, with a corresponding reduction in torque transmission capabilities.

Another consequence of the reduced diameter of the spherical driver is that the driver teeth contact the elevations in the fastener cavity close to the crests of the teeth, resulting in reduced torque transmitting capabilities and accelerated wear.

Finally, in order to accommodate pivoting of the driver with respect to the fastener cavity, the elevations or teeth must extend substantially along the entire surface of the driver. The higher the driver profile, the higher the teeth. However, to preserve the pivoting capabilities of a spherical driver, the increased height of the teeth requires a corresponding decrease in width. The decreased width of the teeth results in lower overall strength and reduced torque transmitting capabilities.

The present invention relates to an elliptical driver with an elliptical cross-section which provides increased surface area available for engagement between the drive element and the fastener, and greater torque transmission. The center point of the elliptical drive element remains below the centerline in the depth of the fastener cavity to prevent the drive element from disengaging with the fastener, even when used in a pivoted orientation.

SUMMARY OF THE INVENTION

The present invention relates to an improved driver element with substantially increased torque transmitting capabilities. The structure of the present invention is also suitable to operate as an articulated joint between connecting shafts.

The preferred drive element of the present invention is attached to an elongated shaft along the central longitudinal axis of the shaft. The minor axis of the elliptical cross-section extends along the central longitudinal axis of the elongated shaft. The elliptical cross-sections of the drive element are located on planes which pass through the minor axis. A major axis plane perpendicular to the minor axis is located at the center of the drive element. The drive element has elevations forming drive lobes and depressions which traverse a longitudinal elliptical path on the surface of the drive element. The lobes and depressions are substantially complimentary to the inner surface of the fastener cavity at the major axis plane. Starting at the major axis plane, the lobes become narrower as they approach the minor axis. The centers of curvature for the tops of the lobes are a series of points which define a first reference circle on the major axis plane with the minor axis as the center. The centers of curvature for the bottoms of the depressions are a series of points which define a second reference circle concentric with the first circle, also on the major axis plane. The drive element of the present invention can effectively transmit increased levels of torque to the fastener even when pivoted with respect to the fastener cavity.

A further advantage of the elliptical driver of the preferred embodiment is that the drive element can be easily inserted into the fastener cavity at an angle with respect to the longitudinal axis of the fastener.

An imaginary centerline perpendicular to the longitudinal axis of the fastener defines a mid-point in the depth of the cavity. The minor axis of the elliptical drive element is shorter than the major axis resulting in a drive element generally shaped like a squashed-ball. Consequently, the intersection of the major and minor axis of the drive element is preferably located below the centerline of the fastener cavity, even when the drive element is pivoted with respect to the fastener axis.

The elliptical drive element has a diameter which is larger than that of the spherical driver, while providing the same degree of angular pivoting with respect to the longitudinal axis of the fastener cavity. Consequently, the larger diameter elliptical drive element has greater surface area available for engagement with the fastener than is possible with a spherical driver.

The "squashed ball" profile of the drive element of the present invention results in an overall reduction of lobe or tooth height. Consequently, the width of the lobes can be increased, without reducing the pivoting capabilities of the elliptical drive element. The wider lobes provide increased overall strength and greater torque transmitting capabilities.

The larger diameter of the elliptical drive element of the present invention moves the point at which the lobes contact the elevations toward the root of the lobes, resulting in greater torque transmitting capabilities and reduced wear.

The transitions between the lobes and the depressions on the drive element of the preferred embodiment are continuous. This results in relatively smooth transitions between the elevations and depressions. Alternatively, the tops of the elevations may be either flat or pointed.

In another embodiment, the lobes on the drive element at the major axis plane are slightly narrower than the depression in the fastener cavity. As a result, sufficient clearance exists to prevent the drive element from becoming rigidly engaged with the fastener cavity during pivoting.

In yet another embodiment, the depressions on the drive element become narrower as they approach the minor axis.

DETAILED DESCRIPTION OF THE PREFERRED EMBODIMENT

Figure 1:
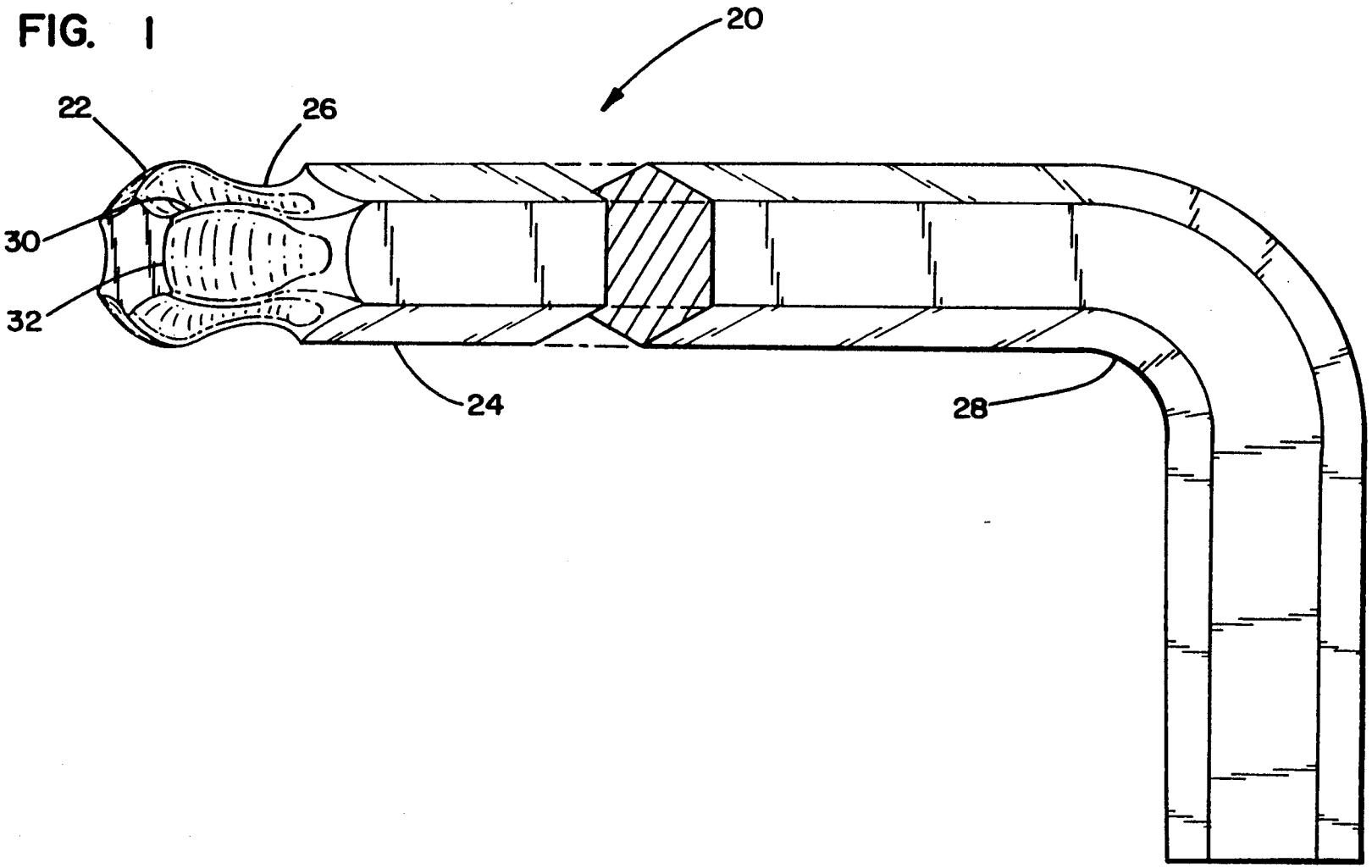
FIG. 1 is a perspective view of a preferred elliptical driver of the present invention.

FIG. 1 is a perspective view of the elliptical driver 20 in a preferred embodiment of the present invention. A drive element 22 with an elliptical cross-section may be attached to the end of a shaft 24. The drive element 22 joins the shaft 24 at a neck 26, which is slightly narrower than the cross-section of either the shaft 24 or the drive element 22. This reduced diameter neck 26 allows the drive element 22 to be pivoted with respect to the center axis of the fastener cavity (see FIG. 2A).

FIG. 1 illustrates the shaft 24 of a preferred embodiment with a bend 28 at the end opposite the drive element 22, for gripping purposes. However, it will be understood by those skilled in the art that a number of configurations are possible and that the length of the shaft 24 is not part of the present invention. For example, the drive element 22 may be attached to a handle or designed to engage with the chuck of a drill.

The drive element 22 contains a series of elevations or lobes 30 (also known as teeth) and depressions 32, which run longitudinally along the elliptical surface of the drive element 22. The lobes 30 and depressions 32 on the drive element 22 of the preferred embodiment may define a continuous curve with smooth transitions. One skilled in the art will recognize that the lobes 30 may also have either flattened or pointed tops.

As is discussed above, the cavity on a standard TORX® compatible fastener has six elevations and six depressions. The drive element 22 of the preferred embodiment has a complimentary structure. However, it will be understood by those skilled in the art that the number of elevations and depressions on the drive element 22 may be varied to accommodate different fasteners, without departing from the scope of the present invention. In particular, increasing the number of elevations 30 and depressions 32 will result in a corresponding increase in the surface area available for engagement between the drive element and fastener cavity (not shown). However, there is a limit to the number of elevations and depressions that would be possible for a given diameter of drive element, since as the number of lobes 30 increases, their size and relative strength must necessarily decrease.

Figure 2A:
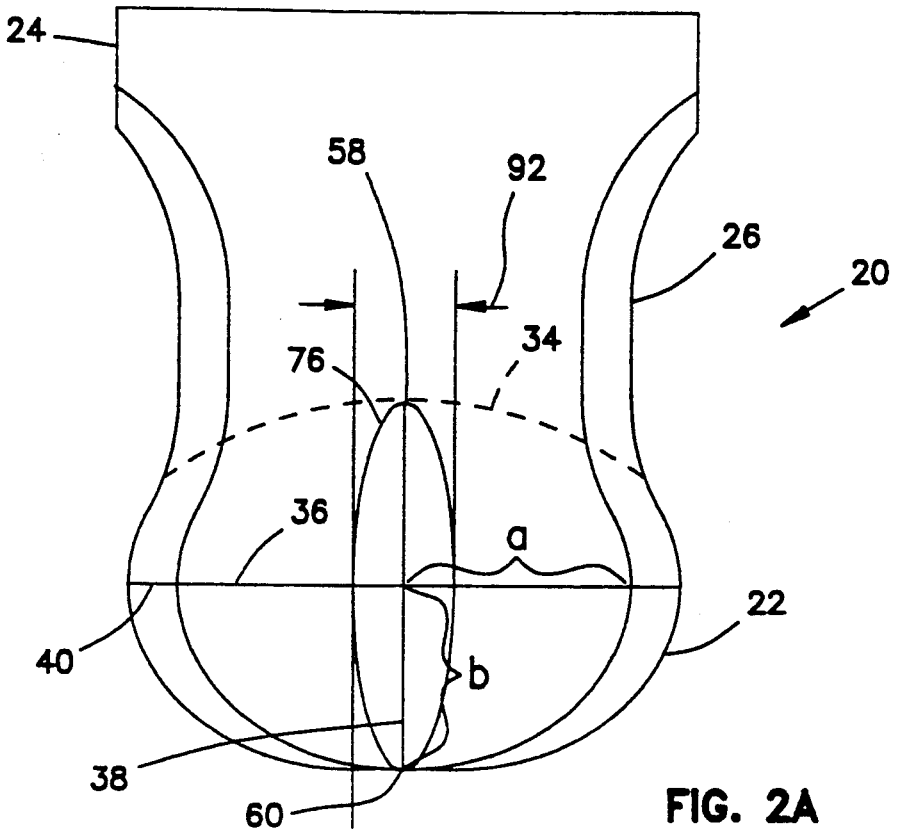
FIGS. 2A and 2B are a profile and end view, respectively, of a preferred elliptical drive element.
Figure 2B:
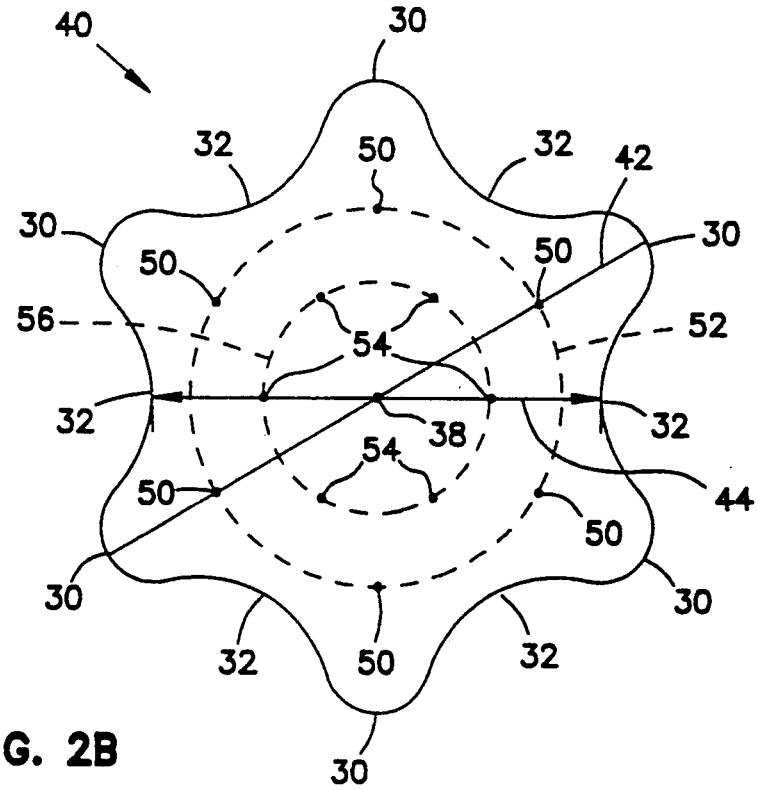

FIGS. 2A and 2B illustrate a side and end view of a preferred drive element 22, respectively. An elliptical cross-section 34 for the outer surface of the drive element 22 is best illustrated in FIG. 2A. An ellipse is defined as a locus of a point which moves so that the sum of its distance from two foci is a constant. The foci are located along the major axis of the ellipse. The standard equation for an ellipse is: $X^2/a^2+y^2/b^2=1$, where the ellipse 34 is located at the origin of the coordinate system. The distance from a center of the ellipse to either foci is defined by the equation:

$$\sqrt{a^2-b^2}$$

where "a" is the radius along the major axis 36 and "b" is the radius along the minor axis 38.

The elliptical cross section 34 is a profile of the maximum radii. The maximum radii of the drive element 22 is defined by rotating the ellipse described above around the minor axis 38. Of course it will be understood that an ellipse defined by passing a plane through the minor axis 38 will vary depending on its location relative to the elevations 30 and depressions 32.

For purpose of analysis, the elliptical drive element 22 may be divided into two parts by a major axis plane 40 which is defined by rotating the major axis 36 around the minor axis 38. For any given point along the longitudinal surface of the elliptical drive element 22, the corresponding foci will be located on the major axis plane 40, as shown in FIG. 2B.

The radius "a" in FIG. 2A varies depending on where the measurement is taken. However, in connection with FIG. 2B, only the tops of the lobes 30 and bottoms of the depressions 32 will be discussed. The center of curvature or foci in the longitudinal direction for the tops of each of the six lobes 30 are defined by six points or lobe foci 50 on the major axis plane 40 which satisfy the equation $$\sqrt{a^2-b^2}\ .$$

These points define a first reference circle 52, the center of which is the minor axis 38. Likewise, the centers of curvature in the longitudinal direction for the bottom 32 of each of the six depressions are six points or depression foci 54 on the major axis plane 40, which define an second reference circle 56 concentric with the first reference circle 52. Therefore, the tops of the lobes 30 and bottoms of the depressions 32 traverse a longitudinal elliptical path 34 along the surface of the drive element 22 of the preferred embodiment. As will be discussed below, the elliptical profile of the drive element 22 of the preferred embodiment has the same or superior pivoting capabilities as a spherical driver.

It will be understood by those skilled in the art that other points along the outer surface of the drive element 22 will have different foci, although the lobe foci 50 and depression foci 54 are of primary interest for purposes of the present discussion. The elliptical drive element 22 of the present invention is defined by a series of different length radii with different center points or foci. On the other hand, a spherical driver 22 of the preferred embodiment is defined by different length radii with a single center point.

Commercially available TORX® compatible screws come in a number of standard sizes. Those familiar with TORX® compatible fasteners will recognize that there is no specific relationship between the size designation of the fasteners and their respective fastener cavities. Also, specialty TORX® compatible fasteners are available with shallow cavities. It will be understood that the major and minor axis of the elliptical shape of the drive element 22 of the present invention may be altered to accommodate a wide variety of fasteners. For example, an exaggerated "squashed ellipse" may be suitable for a fastener with a shallow cavity.

Figure 6:
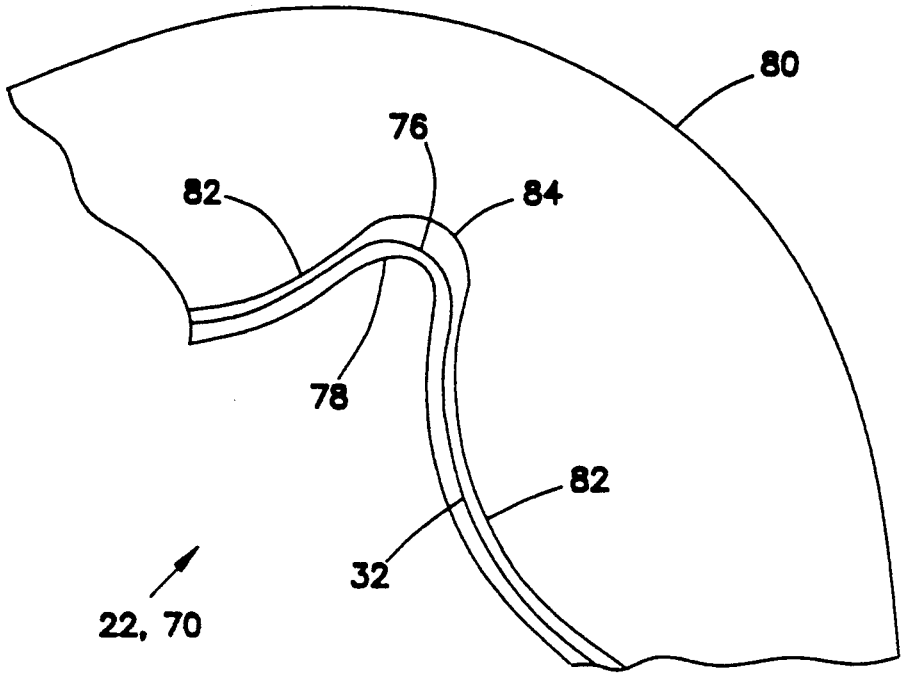
FIG. 6 is a cross-sectional view of FIGS. 4 and 5 showing a portion of a preferred elliptical drive element and spherical driver superimposed on the fastener.

In the preferred embodiment of the present invention, the lobes 30 on the drive element 22 at the major axis plane 40 are slightly narrower than the depression in the fastener cavity (see FIG. 6). As a result, sufficient clearance exists to prevent the drive element 22 from becoming rigidly engaged with the fastener cavity during pivoting.

As can be seen in FIG. 2A, the lobes 30 and depressions 32 on the drive element 22 become narrower as they move from the major axis plane 40 toward the minor axis 38. Correspondingly, the height of the lobes 30 and depth of the depressions 32 decrease as they approach the minor axis 38. The narrowing of the lobes 30 and depressions 32 and reduction in height of the lobes 30 and depth of the depressions 32 enhances the pivotal capabilities of the preferred drive element 22 with the fastener cavity. As will be discussed below, the reduced height of the lobes 30 also allows for wider, and therefore stronger, lobes 30.

In an alternate embodiment, the depressions 32 may become wider and the lobes 30 narrower as they move from the major axis plane 40 to the minor axis 38.

Finally, the elliptical cross section 34 of the drive element 22 of the preferred embodiment does not necessarily extend completely to the minor axis 38 of the ellipse 34. Rather, the ellipse 34 may be "clipped off" near the minor axis 38. The neck 26 which joins the drive element 22 to the shaft 24 clips off the top of the ellipse 58. The bottom of the drive element 22 may optionally be flat, slightly clipping off the bottom of the ellipse 60.

Figure 3A:
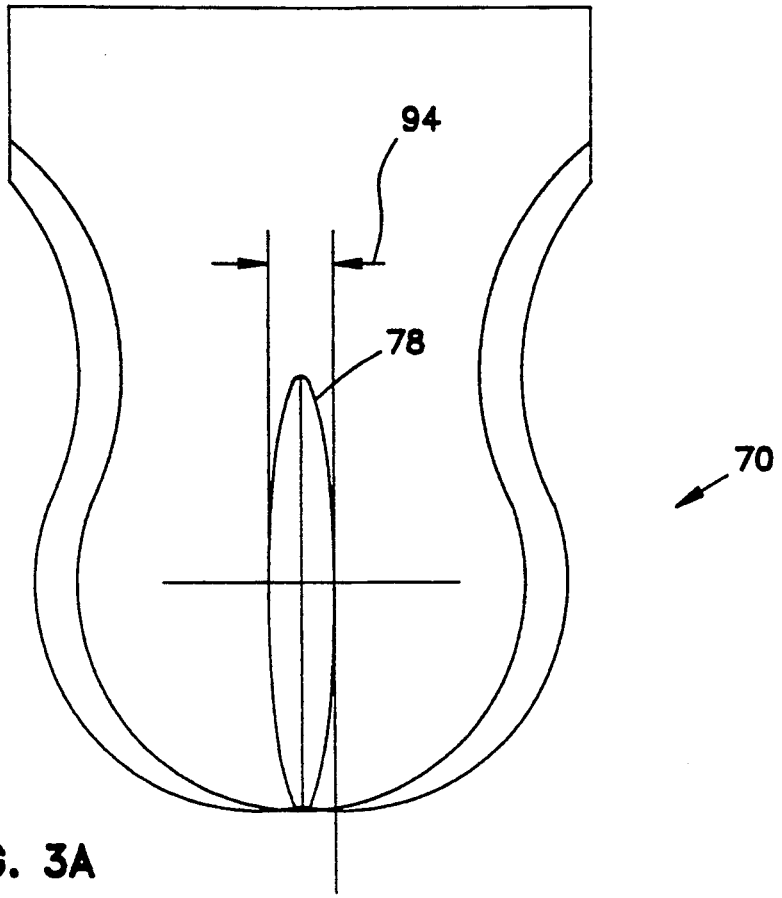
FIGS. 3A and 3B are a profile and end view, respectively, of a spherical driver.
Figure 3B:
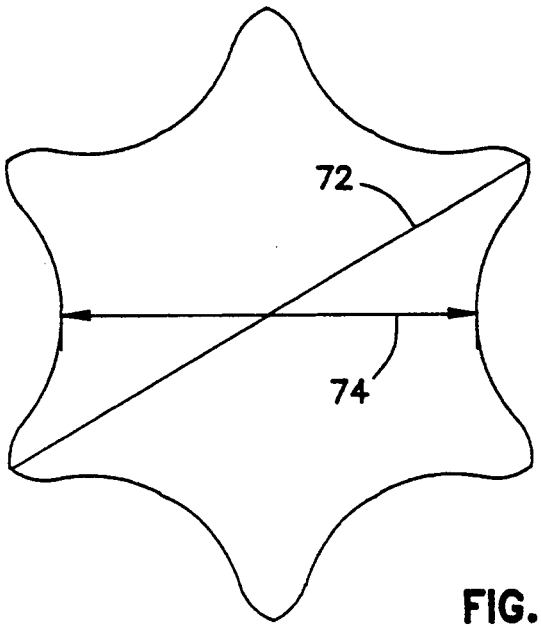

The elliptical drive element 22 illustrated in FIGS. 2A and 2B corresponds to a T-50 TORX® compatible fastener cavity. FIGS. 3A and 3B correspond to a spherical driver 70 also for use with a T-50 TORX® compatible fastener cavity. As discussed above, the elliptical drive element 22 has a major diameter 42 larger than the major diameter 72 of the spherical driver 70. By way of example, the major diameter 42 of the T-50 elliptical drive element 22 is 0.3341 inches, while the major diameter 72 of the T-50 spherical driver 70 is 0.3243 inches. Likewise, the minor diameter 44 of the T-50 elliptical drive element 22 is .2410 inches, whereas the minor diameter 74 on the T-50 spherical driver 70 is 0.2237 inches. As will be illustrated in FIG. 6, as a result of the reduced diameter of the spherical driver 70, the teeth contact the elevations in the fastener cavity close to the crests of the teeth, resulting in accelerated wear.

Additionally, because of the lower profile of the elliptical drive element 22, the height of typical lobes 30, such as example lobe 58, is less than a corresponding tooth 78 on the spherical driver 70, as best illustrated in FIGS. 2A and 3A. Consequently, the width 92 of the elliptical lobe 76 may be substantially wider than the width 94 of the spherical tooth 78.

The wider tooth 58 is capable of transmitting substantially more torque than the tooth 78 on the spherical driver before failure occurs, while providing comparable or improved pivoting capabilities. By way of example, the width of the lobe 76 on the elliptical drive element 22 is 0.0550 inches, while the width of a tooth 78 on the corresponding spherical driver 70 is 0.0351 inches. The lobe 76 on the elliptical drive element 22 is 57% wider.

The elliptical drive element 22 of the preferred embodiment transmits between 74% to 97% of the torque of various standard TORX® compatible drivers, as set forth in the table below. For the T-20 and T-30 sizes, the spherical driver 70 discussed above has approximately half of the torque transmitting capabilities of the corresponding elliptical drive element 22 of the present invention. (Torque data is presently available only for the T-20 and T-30 spherical drivers 70.) For example, the T-20 spherical driver can only transmit 47 inch lbs., or 47% of the torque possible with a standard TORX® compatible driver. The T-30 spherical driver can only transmit 133 inch lbs., or 49% of the torque of a compatible driver. As is clear from the table below, the torque transmitting capabilities for the corresponding elliptical drive element 22 of the present invention are 94% and 85%, respectively, demonstrating the clear advantages of the design of the present invention. All measurements are in INCH LBS.

TORQUE TRANSMITTING CAPABILITIES OF THE ELLIPTICAL DRIVE ELEMENT

| TOOL SIZE | STANDARD TORX DRIVER | ELLIPTICAL DRIVE ELEMENT | % OF STANDARD TORX DRIVER |
|---|---|---|---|
| T-9 | 34 inch-lbs. | 33 inch-lbs. | 97% |
| T-10 | 36 inch-lbs. | 35 inch-lbs. | 97% |
| T-15 | 62 inch-lbs. | 56 inch-lbs. | 90% |
| T-20 | 99 inch-lbs. | 94 inch-lbs. | 94% |
| T-25 | 126 inch-lbs. | 111 inch-lbs. | 88% |
| T-27 | 205 inch-lbs. | 150 inch-lbs. | 74% |
| T-30 | 270 inch-lbs. | 223 inch-lbs. | 85% |

Figure 5:
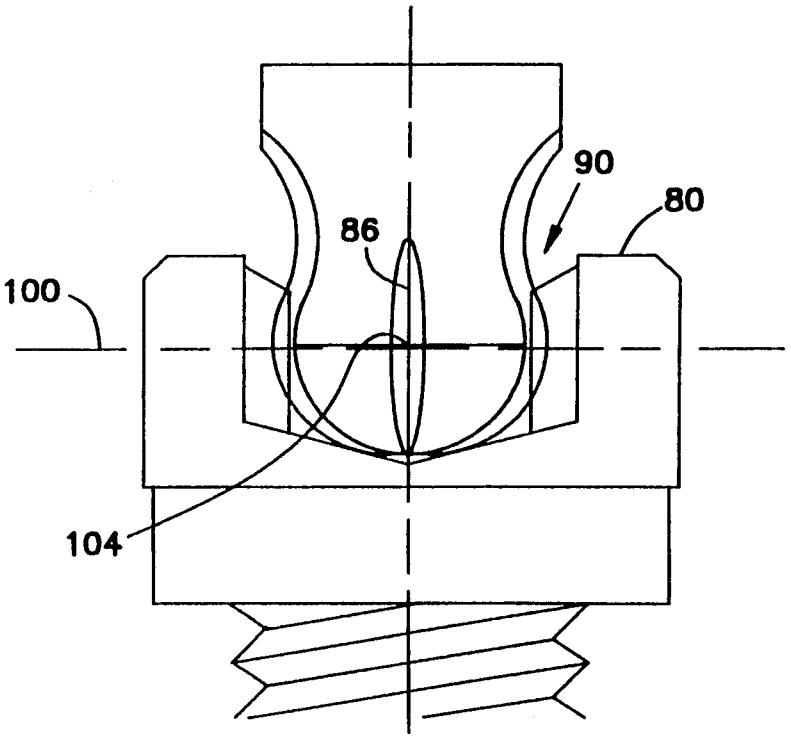
FIG. 5 is a side view of a spherical driver engaged with a T-50 TORX ® compatible fastener.
Figure 4:
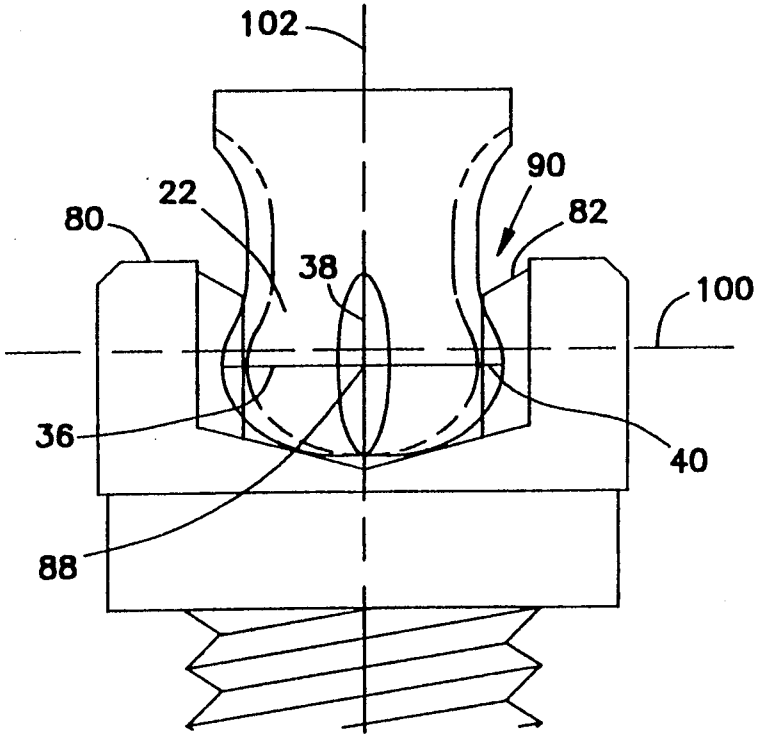
FIG. 4 is a side view of a preferred elliptical drive element engaged with a T-50 TORX®compatible fastener.

FIGS. 4 and 5 illustrate a side view of a T-50 TORX® compatible fastener 80 engaged with a preferred elliptical drive element 22 and a spherical driver 70, respectively. The lobes 30 and depressions 32 on the elliptical drive element 22 are preferably complementary to the fastener cavity elevations 82 and depressions (not shown) at the major axis plane 40. Because the minor axis 38 of the elliptical drive element 22 is shorter than the diameter 86 of the spherical driver 70, the elliptical drive element 22 has a lower side profile and lower center point 88 with respect to the fastener cavity 90.

A mid-point in the depth of the fastener cavity 90 is defined by a centerline 100, which is perpendicular to the longitudinal fastener axis 102. As is clearly illustrated in FIG. 4, the center point 80 of the preferred elliptical drive element 22 is clearly below the centerline 100 on the fastener 80. However, the center of the spherical driver 104 is above the centerline 100 of the fastener cavity 90, as shown in FIG. 5. By locating the center point 104 of the spherical driver 70 above the centerline 100 of the fastener cavity 90, the driver 70 will have a tendency to disengage or "walk out" of the fastener cavity 90 as torque is applied. Therefore, the elliptical drive element 22 of the present invention has greater torque transmitting capabilities than a spherical driver 70.

It will be recognized that some specialty TORX® compatible fasteners may have shallow cavities 90 in which the center point 88 of the preferred drive element 22 would be above the center line 100. However, the preferred drive element 22 of the present invention has superior operational capabilities over its spherical counterpart, even in a shallow fastener cavity. Further, the drive element 22 of the present invention can be constructed with an exaggerated "squashed elliptical structure" to accommodate shallow fastener cavities.

FIG. 6 is a cross-sectional view of FIGS. 4 and 5 taken at approximately the center line 100, showing a portion of the elliptical drive element 22 and the spherical driver 70 superimposed on the fastener 80. As is clear from FIG. 6, the larger diameter of the elliptical drive element 22 moves the point at which the lobes 76 contact the elevations 82 on the fastener 80 toward the root of the lobes 82, resulting in greater torque transmitting capabilities. On the other hand, tooth 78 on the spherical driver 70 contacts closer to the crest of lobe 82. FIG. 6 also illustrates the increased width of the lobe 76 on the elliptical drive element 22 with respect to the tooth 78. As will be understood by those skilled in the art, the increased width of lobe 76 will result in reduced wear.

Figure 8:
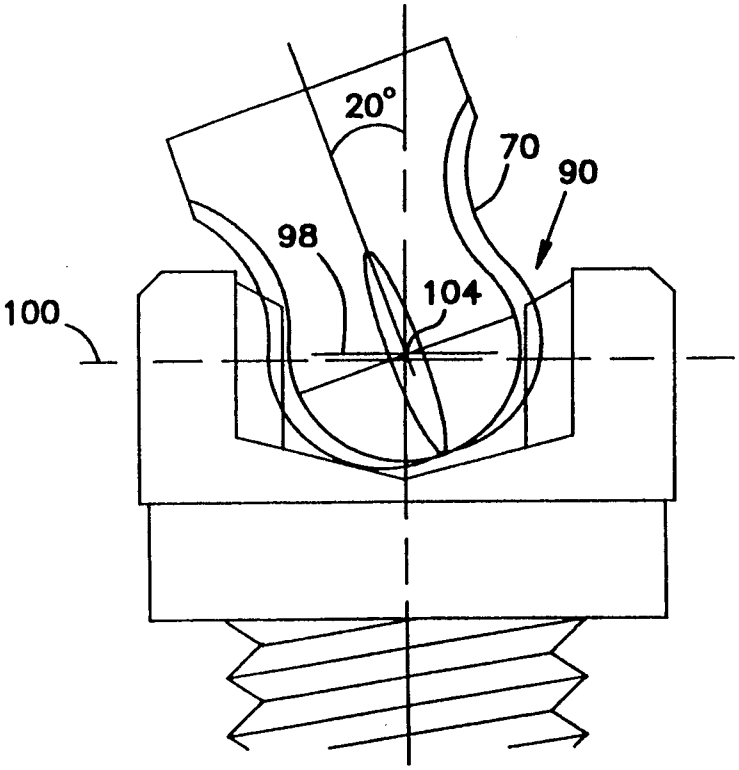
FIG. 8 is a side view of a spherical driver engaged with a T-50 TORX® compatible fastener at an angle of 20°.
Figure 7:
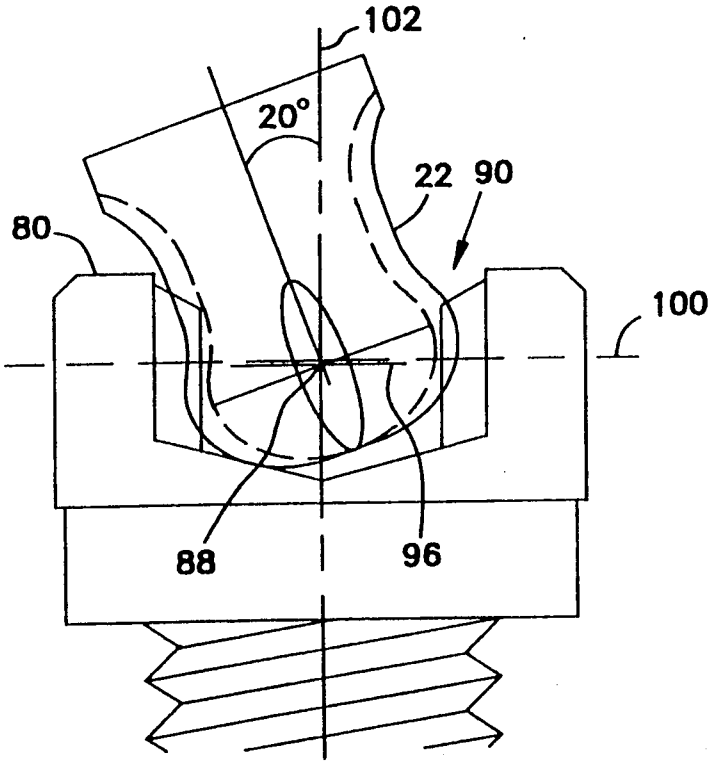
FIG. 7 is a side view of a preferred elliptical drive element engaged with a T-50 TORX® compatible fastener at an angle of 20°.

FIGS. 7 and 8 illustrate a preferred elliptical drive element 22 and a spherical driver 70 for a T-50 TORX® compatible fastener at an angle of rotation of 20°, respectively. A line 96 perpendicular to the longitudinal axis 102 passes through the center point 88 of the elliptical drive element 22 below the centerline 100. On the other hand, a line 98 parallel to the centerline 100 passing through the center 104 of the spherical driver 70 is substantially above the centerline 100.

As discussed above, because the center 104 of the spherical driver 70 is above the center line 100 of the cavity 90, the spherical driver 70 tends to disengage when rotated. The problem of walk-out discussed above becomes particularly acute when the spherical driver 70 is pivoted with respect to the longitudinal axis 102 of the fastener 80. The greater the angle of pivot, the more likely the spherical driver 70 will disengage with the fastener cavity.

Figure 10:
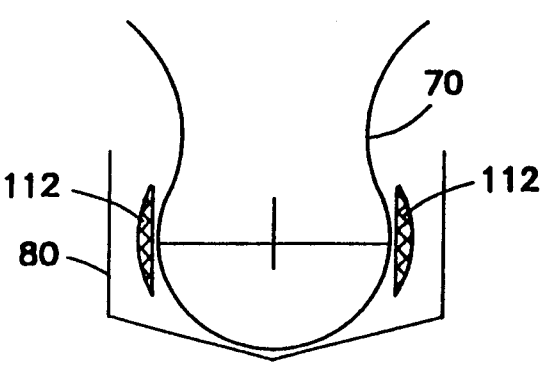
FIG. 10 is a side view of a spherical driver illustrating the surface area available for engagement with a T-50 TORX ® compatible fastener.
Figure 9:
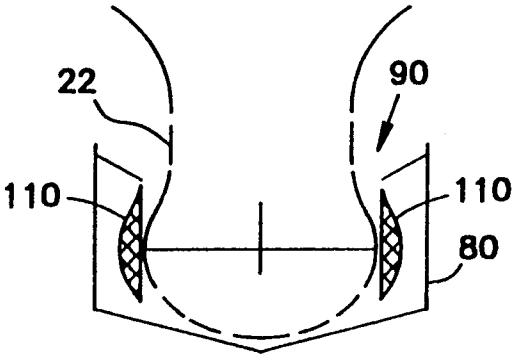
FIG. 9 is a side view of a preferred elliptical drive element illustrating the surface area available for engagement with a T-50 TORX® compatible fastener.

Another advantage of the preferred elliptical drive element 22 is that the surface area available for engagement 110 between the elliptical drive element 22 and the fastener cavity 90 is significantly increased. FIGS. 9 and 10 illustrate the lobe or tooth surface area available for engagement of the elliptical drive element 22 and the spherical driver 70 with the fastener cavity 90 of a T-50 TORX® compatible fastener, respectively. The surface area available for engagement 110 of the lobes 30 on the elliptical drive element 22 is 0.1016 sq. inches, whereas the contact area 112 on the spherical driver 70 is 0.0829 sq. inches. The elliptical drive element 22 has 22.5% more surface area available for engagement 110 with the fastener cavity 90, resulting in significantly increased torque transmission capabilities.

Figure 12:
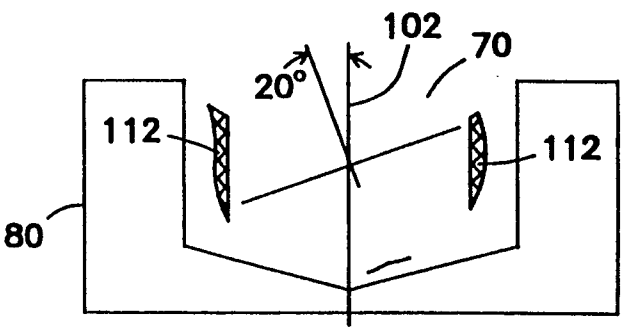
FIG. 12 is a side view of a spherical driver illustrating the surface area available for engagement with a T-50 TORX® compatible fastener at an angle of 20°.
Figure 11:
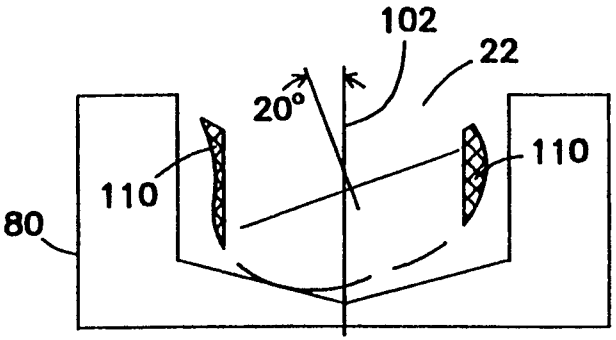
FIG. 11 is a side view of a preferred elliptical drive element illustrating the surface area available for engagement with a T-50 TORX® compatible fastener at an angle of 20°.

FIGS. 11 and 12 illustrate the surface area available for engagement 110 and 112 for the preferred elliptical drive element 22 and spherical driver 70 discussed above at a 20% angle of rotation with respect to the longitudinal axis 102. While the surface area available for engagement 110 on the lobes 30 generally decreases as the drive element 22 is pivoted, the elliptical drive element 22 still has more than 21% greater surface area available for engagement 110 than the spherical driver 70.

A summary of this analysis, including information relating to the T-40 TORX® compatible fastener, is set forth in the table below. The values are actual surface area in Square Inches for rotation in one direction.

| FASTENER TYPE | ELLIPSE | SPHERE | % INCREASE OF SURFACE AREA ON ELLIPTICAL DRIVER |
|---|---|---|---|
| SURFACE AREA AVAILABLE FOR ENGAGEMENT | | | |
| T-50 | .1016 Sq. In. | .0829 Sq. In. | 22.5% |
| T-40 | .0818 Sq. In. | .0638 Sq. In. | 28.3% |
| SURFACE AREA AVAILABLE FOR ENGAGEMENT AT 20° OF ROTATION | | | |
| T-50 | .0982 Sq. In. | .0808 Sq. In. | 21.5% |
| T-40 | .0665 Sq. In. | .0468 Sq. In. | 42.0% |

Figure 13:
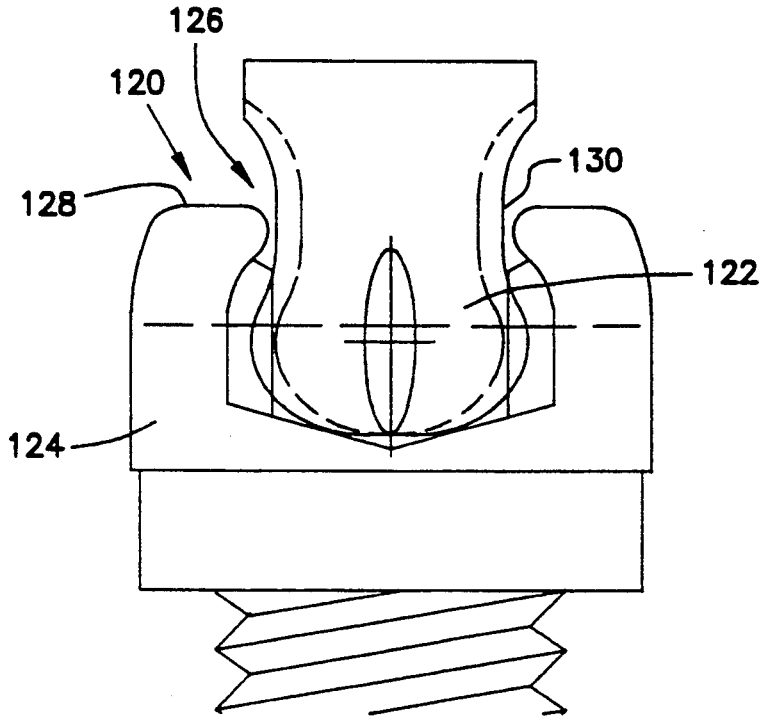
FIG. 13 is a side view of a preferred elliptical drive element used as part of an articulated joint.

The preferred elliptical drive element of the present invention may also operate as part of an articulated joint 120 with increased torque transmission capabilities, as illustrated in FIG. 13. An elliptical drive element 122 may be mated with a receiving element 122 having a cavity 126 substantially similar to that of a TORX® compatible fastener. A top surface of the cavity 128 extends inward towards a neck 130 of the elliptical drive element 122. This structure prevents the drive element 122 from disengaging from the receiving element 124.

It will be understood that the present invention is not limited to the examples discussed above, but may be changed or modified without departing from the spirit or scope of the present invention. For example, the number of elevations and lobes on the drive element can be varied according to the fastener cavity. Further, the major axis of the elliptical drive element may be increase to create an exaggerated "squashed driver".

What is claimed is:

1. An elliptical driver for transmitting torque to a cavity in the head of a fastener, the inner surfaces of the cavity defining a continuous curve of uniformly distributed elevations and depressions parallel to a fastener axis passing longitudinally through the center of the fastener and the cavity, comprising:

a shaft with a central longitudinal axis; and a drive element with an elliptical cross section secured to said shaft, said drive element having a minor axis extending along said central longitudinal axis of said shaft and a major axis plane perpendicular to said minor axis at the center of said drive element, said elliptical cross section located on planes containing said minor axis, said drive element having elevations forming drive lobes and depressions which traverse a longitudinal elliptical path on the surface of said drive element, said lobes and depressions being substantially complementary to the inner surface of the cavity at said major axis plane and said lobes becoming narrower as they approach said minor axis, the centers of curvature of the tops of said lobes being located at a plurality of points defining a first circle on said major axis plane with the center of said first circle being said minor axis, the centers of curvature of the bottom of said depressions located at a plurality of points defining a second circle concentric with said first circle on said major axis plane, and a center line perpendicular to the fastener axis defining a mid point in the depth of the cavity so that the intersection of said minor and said major axis of said drive element is located below the center line when engaged with the cavity, whereby said drive element can effectively transmit tongue to the fastener even when pivoted with respect to the fastener axis.

2. The apparatus of claim 1 wherein the transitions between said lobes and said depressions on said drive element are continuous.

3. The apparatus of claim 1 wherein drive element has six depressions and six elevations.

4. An elliptical driver for transmitting torque to a cavity in the head of a fastener, the inner surfaces of the cavity defining a continuous curve of uniformly distributed elevations and depressions parallel to a fastener axis passing longitudinally through the center of the fastener and the cavity, comprising:

a shaft with a central longitudinal axis; and a drive element with an elliptical cross section secured to said shaft, said drive element having a minor axis extending along said central longitudinal axis of said shaft and a major axis plane perpendicular to said minor axis at the center of said drive element, said elliptical cross section located on planes containing said minor axis, said drive element having elevations forming drive lobes and depressions which traverse a longitudinal elliptical path on the surface of said drive element, said lobes and depressions being substantially complementary to the inner surface of the cavity at said major axis plane and said lobes becoming narrower as they approach said minor axis, the centers of curvature of the tops of said lobes being located at a plurality of points defining a first circle on said major axis plane with the center of said first circle being said minor axis, the centers of curvature of the bottom of said depressions located at a plurality of points defining a second circle concentric with said first circle on said major axis plane, and a center line perpendicular to the fastener axis defining a mid point in the depth of the cavity so that the intersection of said minor and said major axis of said drive element is located below the center line when said drive element is engaged with the cavity at angle with respect to the fastener axis, whereby said drive element can effectively transmit torque to the fastener even when pivoted with respect to the fastener axis.

* * * * *

UNITED STATES PATENT AND TRADEMARK OFFICE

CERTIFICATE OF CORRECTION

PATENT NO. : 5,251,521

DATED : October 12, 1993

INVENTOR(S) : Dennis A. Burda et al.

It is certified that error appears in the above-identified patent and that said Letters Patent is hereby corrected as shown below:

In column 1, line 51, "TROX" should read --TORX--.

In column 5, line 43, delete "32" after the word "bottom".

In column 5, line 44, insert --32-- after the word "depressions".

In column 7, line 16, insert --TORX -- after the letter "a".

In column 10, line 11, "tongue" should read --torque--.

Signed and Sealed this

Twenty-fourth Day of May, 1994

*Attest:*

Bruce Lehman

BRUCE LEHMAN

*Attesting Officer*

*Commissioner of Patents and Trademarks*